United States Patent [19]

LaCount

[11] 4,434,974

[45] Mar. 6, 1984

[54] PNEUTMATIC HOIST BRAKE AND CONTROL

[75] Inventor: Kenneth H. LaCount, Green Bay, Wis.

[73] Assignee: Cooper Industries, Inc., Houston, Tex.

[21] Appl. No.: 325,239

[22] Filed: Nov. 27, 1981

[51] Int. Cl.[3] ..... B66D 1/08; B66D 3/20; B66D 5/12; B66D 5/26

[52] U.S. Cl. ..... 254/360; 188/170; 192/3 TR; 254/372; 254/379; 254/380; 254/382

[58] Field of Search ..... 254/360, 372, 371, 378, 254/379, 380, 382; 137/881, 887; 192/3 R, 3 TR, 4 R; 188/170

[56] References Cited

U.S. PATENT DOCUMENTS

| | | | |
|---|---|---|---|
| 2,827,880 | 3/1958 | Shaff | 254/360 |
| 2,927,669 | 3/1960 | Walerowski | 192/4 R |
| 2,989,288 | 6/1961 | Smith | 254/360 |
| 3,125,200 | 3/1964 | Kaman | 254/360 |
| 3,848,716 | 11/1974 | Hanning | 188/170 |

*Primary Examiner*—Billy S. Taylor

*Attorney, Agent, or Firm*—Wilson, Fraser, Barker & Clemens

[57] ABSTRACT

A pneumatic brake assembly for incorporation into chain hoists and the like includes a planar disk slidably secured to the output shaft of a pneutmatic motor by complementary splines. The disk is biased toward a planar surface and when in contact with such surface, inhibits rotation of the motor output shaft. Compressed air is supplied to both the pneumatic motor and the brake assembly through a network of passageways and check valves. Compressed air supplied to one face of the brake disk, translates the disk, disengaging it from the planar surface and permitting output shaft rotation.

11 Claims, 4 Drawing Figures

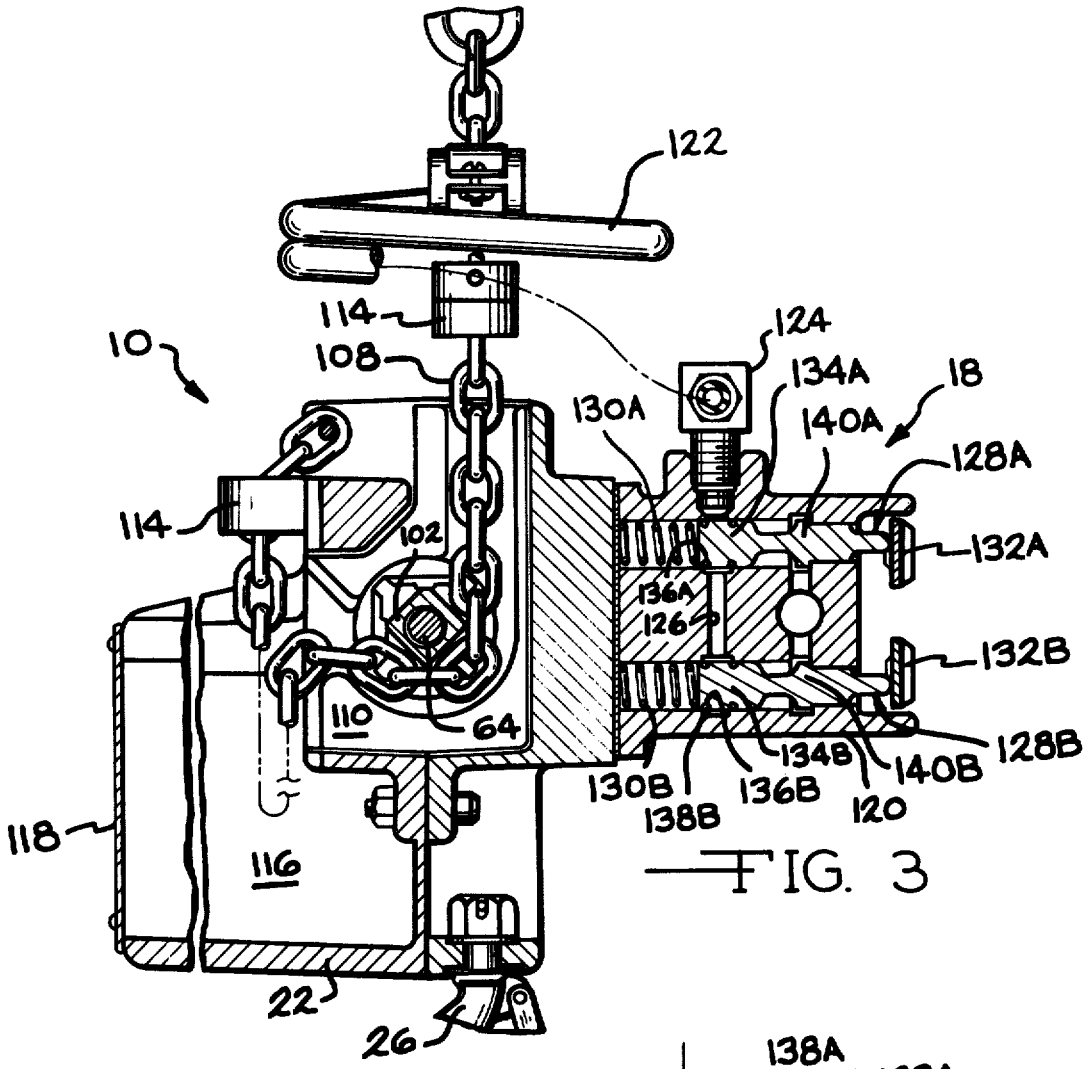
FIG. 3
FIG. 4
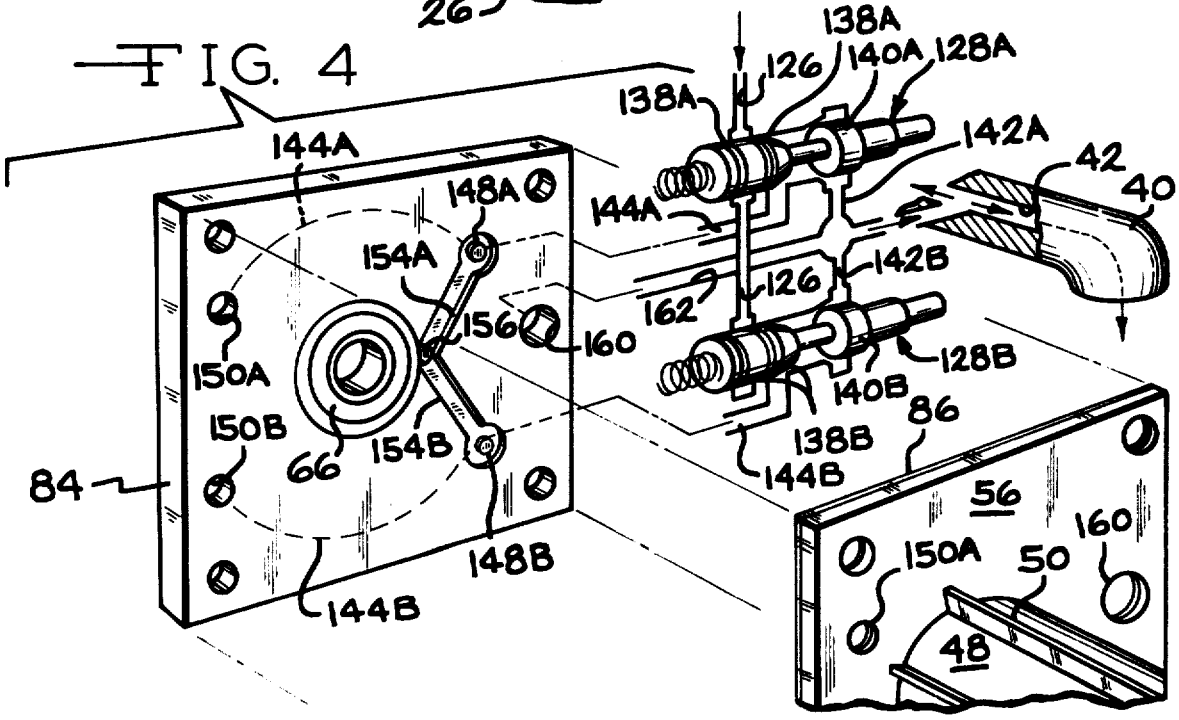

PNEUTMATIC HOIST BRAKE AND CONTROL

BACKGROUND OF THE INVENTION

The invention relates generally to pneumatic mechanical control systems and more particularly to a pneumatic brake and valve arrangement for use in chain hoists and similar equipment having pneumatically driven motors.

Pneumatically driven motors enjoy significant use as sources of rotary energy in diverse applications. This use is the result of many considerations, for example, output power versus size, serviceability and simplicity, to name but three. Pneumatic powered motors also exhibit insignificant spark ignition and shock hazards when compared to their electrically driven counterparts. These features and others have encouraged their acceptance on production lines, assembly stations, machine shops and service and repair facilities.

A pneumatically powered device which has found acceptance in all of these locations is a chain hoist. Typically, such devices include a relatively high speed, low torque motor, a speed reducing mechanism, a brake assembly and a hook terminated chain which is played in and out by the drive components, lowering and raising the hook. Appropriate ports in the motor housing and associated valves provide reversible motor operation and brake application when the motor is quiescent.

Hoist designs incorporating these general features are illustrated in U.S. Pat. Nos. 2,823,775, 2,927,669 and 3,125,200. The first of these patents teaches a hoist having a pneumatically powered motor and mechanically activated band-type brake. The second patent illustrates a similar device having a pneumatically activated brake. The brake comprises a fixed piston and translating cylinder and a frusto-concial brake which is supplied with air from within the motor. The last patent illustrates a hoist having a disk brake which is released by the application of compressed air to an adjacent spring-biased diaphragm. U.S. Pat. No. 3,848,716 discloses a more contemporary pneumatic hoist and brake wherein exhaust air from the motor is utilized to activate a spring-biased frusto-conical brake assembly.

Each of these designs represents a motor drive and brake configuration approached from a slightly different perspective and with slightly different weight accorded various design parameters. Similarly, each design exhibits specific shortcomings, for example, the brake in U.S. Pat. No. 2,823,775 apparently may be released without motor activation if an air supply to the hoist is lacking. The device of U.S. Pat. No. 3,125,200 is exceptionally complex and the air supply to the brake in U.S. Pat. No. 3,848,716 may create significant back pressure in the motor exhaust thereby reducing the efficiency and power output of the motor.

SUMMARY OF THE INVENTION

The instant invention comprehends a pneumatic brake and control valve arrangement for use in chain hoists and the like. The brake includes a planar disk slidably secured to the output shaft of a pneumatic motor by complimentary splines or similar means. Adjacent the brake disk is a planar surface of complimentary diameter against which the brake disk is biased by a compression spring in order to inhibit rotation of the motor. A pair of spring-biased control valves selectively supply compressed air to the pneumatic motor through a respective pair of passageways and ports thereby accomplishing bidirectional rotation of the motor in accordance with conventional practice. In addition to an exhaust port disposed substantially opposite the pair of ports, each of the pair of ports functions, if not as an inlet port, as a second exhaust port. A pair of check valves provide compressed air to the brake and inhibit supply air flow into the passageways associated with reverse motor direction. The compressed air disengages the brake disk from the adjacent complementary surface and permits rotation of the pneumatic motor while air is supplied thereto.

It is thus an object of the instant invention to provide a pneumatically powered chain hoist having a pneumatically activated brake.

It is a further object of the instant invention to provide a pneumatically powered chain hoist assembly which releases only with the application of compressed air.

It is a still further object of the instant invention to provide a pneumatically powered chain hoist brake which, in operation, does not adversely affect the performance of the hoist motor.

It is a still further object of the instant invention to provide a pneumatically powered chain hoist brake assembly which is straightforward in design and simple to operate and maintain.

Further objects and advantages of the instant invention will become apparent by reference to the following description and appended drawings.

BRIEF DESCRIPTION OF THE DRAWINGS

FIG. 3 is a full sectional end view of a pneumatically powered chain hoist incorporating the instant invention; and FIG. 4 is a diagrammatic, exploded perspective view of a control system for a pneumatically activated brake according to the instant invention.

DESCRIPTION OF THE PREFERRED EMBODIMENT

Figure 1:
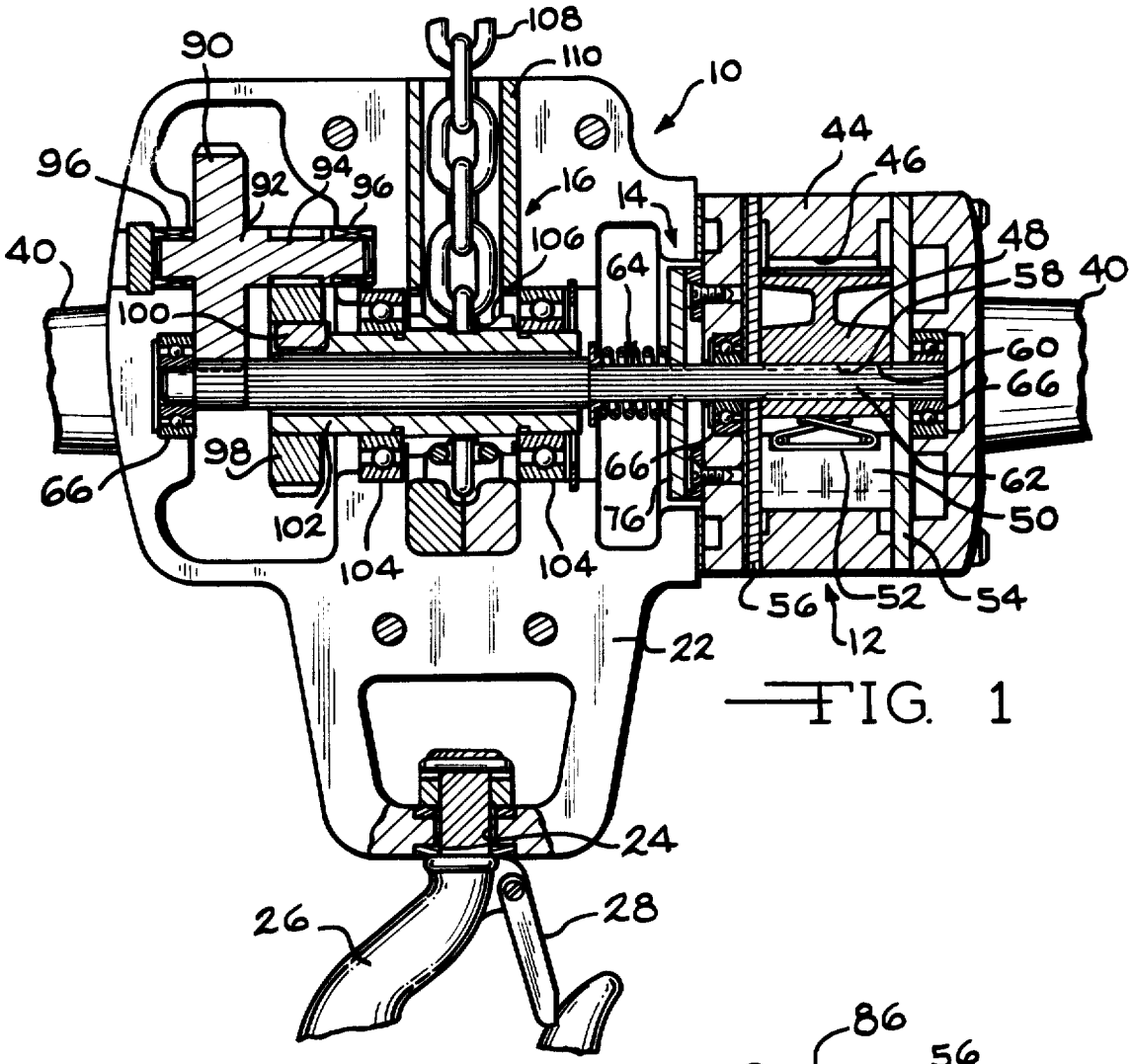
FIG. 1 is a full sectional side view of the pneumatically powered chain hoist incorporating the instant invention.

Referring to FIGS. 1 and 3, a pneumatic hoist incorporating the instant invention is illustrated and generally designated by the reference numeral 10. The hoist 10 includes a pneumatic motor assembly 12, a pneumatic brake assembly 14, a speed reduction and drive assembly 16 and a control assembly 18 which are generally disposed within or secured to a multi-part housing 22. The housing 22 is preferably diecast of a suitable material such as aluminum and includes various chambers and apertures which receive components of the above delineated assemblies. Rotatably disposed and axially restrained within an opening 24 in the lower portion of the housing 22 is a hook 26 having a spring-biased safety latch 28. The hook 26 is suitable for and is utilized in a conventional manner to engage articles which are to be lifted by the pneumatic hoist 10. The housing also includes an elongate, horizontally extending handle 40. The handle 40 is hollow and defines an exhaust passageway 42, illustrated in FIG. 4, the function of which will be described subsequently. The handle 40 may be utilized to facilitate movement and positioning of the pneumatic hoist 10 during use.

Referring now to FIG. 1, the pneumatic motor assembly 12 is a conventional vane motor having a housing 44. The housing 44 defines a chamber 46 within which a rotor 48 is disposed. The rotor 48 defines a plurality of radially disposed slots which receive a like plurality of radially translatable vanes 50. The vanes 50 are biased radially outwardly into contact with the wall surface of the chamber 46 by a like plurality of compression springs 52. A pair of opposed, parallel end plates 54 and 56 seal and define the chamber 46, the end plate 56 more proximate the housing 22 of the pneumatic hoist 10 having passageways defined therein for the supply and removal of compressed air from the chamber 46 as will be more fully described subsequently.

The rotor 48 of the pneumatic motor assembly 12 defines a concentrically disposed opening 58 and female spline set 60 which slidably receives complementary male splines 62 disposed on an elongate, dual diameter drive shaft 64. The elongate drive shaft 64 is supported by a plurality of spaced-apart, anti-friction bearings such as ball bearings 66.

Figure 2:
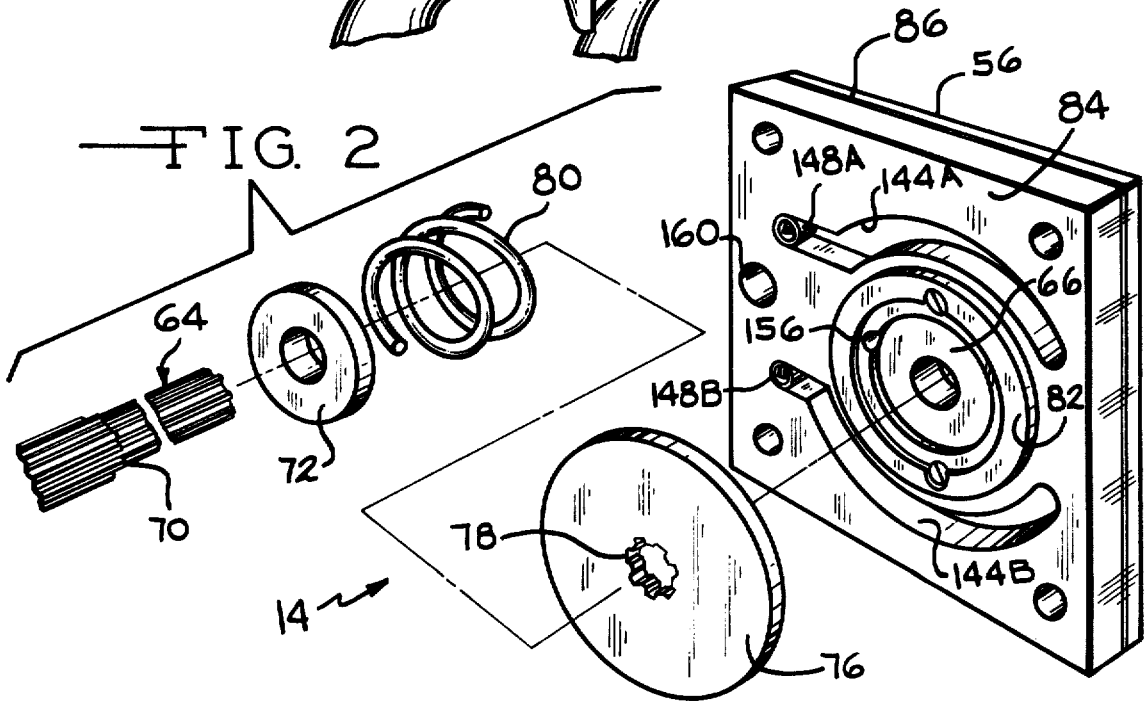
FIG. 2 is a fragmentary, exploded perspective view of a pneumatically activated brake according to the instant invention.

Referring now to FIGS. 1 and 2, the pneumatic brake assembly 14 is diposed about the smaller diameter portion of the dual diameter splined drive shaft 64 adjacent the pneumatic motor assembly 12. The drive shaft 64 includes a step or shoulder 70 against which a spring retaining collar or washer 72 seats. A brake disk 76 is also disposed about this portion of the drive shaft 64 and defines a centrally disposed opening with female splines 78 complementary to the male splines 62 on the drive shaft 64. The brake disk 76 may be fabricated of any suitable long wearing metallic material. Bronze over steel has been found to be particularly suitable. A compression spring 80 is disposed concentrically about the drive shaft 64 between the washer 72 and the brake disk 76. The spring rate of the compression spring 80 is dictated by such considerations as the pressure of the compressed air applied to the pneumatic hoist 10, the effective area of the brake disk 76 and the required brake torque. A spring rate in the range of from 100 to 110 pounds per inch has been found appropriate but it should be understood that this parameter may be adjusted over a broad range to match various applications. The compression spring 80 biases the brake disk 76 into contact with an annular brake pad 82. The brake pad 82 may be fabricated of any suitable brake or clutch surface material. The brake pad 82 is secured to a port plate 84 disposed generally between the housing 22 and the pneumatic motor assembly 12. Preferably, a gasket 86 disposed between the port plate 84 and the end plate 56 of the pneumatic motor assembly 12 ensures proper sealing of the various passageways within the port plate 84.

Referring again to FIG. 1, the larger diameter portion of the dual diameter drive shaft 64 extends across the housing 22 and supplies rotary energy to the reduction and drive assembly 16. At the end of the drive shaft 64 opposite the pneumatic motor assembly 12, an idler gear 90 engages the drive shaft 64. The idler gear 90 is supported upon a stub shaft 92 which includes gear teeth constituting a pinion gear 94. The idler gear 90, the stub shaft 92 and the pinion gear 94 may all be integrally formed as a single component. The stub shaft 92 is supported in suitable bearings 96 within the housing 22. The pinion gear 94 engages a second idler gear 98 which is secured by a keyway 100 or other similar fastening means to an elongate chain drive sprocket 102. The chain drive sprocket 102 is preferably supported in anti-friction bearings such as ball bearings 104 and includes a suitably contoured external region 106 which engages a conventional link chain 108. Liners 110 generally disposed between the link chain 108 and the housing 22 maintain the chain 108 in proper orientation and ensure engagement between the chain 108 and the drive sprocket 102.

With brief reference to FIG. 3, it will be appreciated that the pneumatic chain hoist 10 according to the instant invention climbs and descends the stationary chain 108 rather than raises and lowers a chain from a fixed position. In this regard, it has been found preferable to include a pair of upper and lower stop blocks 114 secured to the chain 108 at suitable locations to inhibit travel of the hoist 10 therebeyond. The stop blocks 114 may be fabricated of any suitable material such as steel and may include a resilient face portion of cushioning rubber, for example. The housing 22 defines a chamber 116 which receives the chain 108 as the hoist 10 climbs it. The chamber 116 is preferably closed by a suitable coverplate 118.

Referring now to FIGS. 3 and 4, the control assembly 18 is disposed within a housing 120 which is secured to the housing 22 by suitable fasteners (not illustrated). A coiled air supply line 122 provides compressed air through an inlet fitting 124 to the control assembly 18. The inlet fitting 124 communicates with and supplies compressed air to an inlet passageway 126. The control assembly 18 also includes a pair of valve spools 128A and 128B which are biased toward the positions illustrated by a respective pair of compression springs 130A and 130B. When translated by movement of one of the manually operated actuators 132A or 132B, the valve spools 128A and 128B control, respectively, the upward and downward motion of the pneumatic hoist 10. Each of the valve spools 128A and 128B includes a first enlarged diameter region 134A and 134B, respectively, which in turn defines pairs of circumferential grooves 136A and 136B within which are seated respective pairs of O-ring seals 138A and 138B. Each of the valve spools 128A and 128B also includes a second enlarged diameter region 140A and 140B which is spaced from the first enlarged diameter region 134A and 134B by a region of smaller diameter. Disposed generally adjacent the second regions of enlarged diameter 140A and 140B of the valve spools 128A and 128B are exhaust passageways 142A and 142B. The exhaust passageways 142A and 142B are open and communicate about the second regions of enlarged diameter 140A and 140B into the annular space between the regions of enlarged diameter when the valve spools 128A and 128B are in their relaxed positions, as illustrated in FIGS. 3 and 4. Disposed generally between the inlet passageway 126 and the exhaust passageways 142A and 142B and the first and second enlarged diameter regions 134A, 134B and 140A and 140B of the valve spools 128A and 128B, respectively, are a respective pair of air passageways 144A and 144B. The air passageways 144A and 144B communicate with a respective pair of check valves 148A and 148B and ports 150A and 150B. The ports 150A and 150B extend through the gasket 86 and the end plate 56 and communicate with the chamber 46 of the pneumatic motor assembly 12. The check valves 148A and 148B provide a one-way flow of air from the passageways 144A and 144B to a pair of converging passageways 154A and 154B which merge at a common brake supply port 156. The support port 156 extends through to the opposite face of the port plate 84. The port plate 84 further includes an exhaust port 160 which extends from the chamber 46 of the pneumatic motor assembly 12, through the end plate 56, the gasket 86 and communicates with an exhaust passageway 162. The exhaust passageway 162 intersects with the pair of exhaust passageways 142A and 142B and finally merges with the exhaust passageway 42 in the handle 40.

The operation of the pneumatic hoist 10 is straightforward and will be described with reference to all the drawing figures, especially FIG. 4. Compressed air is supplied to the hoist 10 through the coiled, compressed air supply line 122 and into the inlet passageway 126. As noted previously, the valve spool 128A is activated to raise the hoist 10 and thus a load engaged by the hook 26 and the valve spool 128B is activated to lower the hoist 10 and associated load. Such operation is achieved by depressing one of the two actuators 132A and 132B. As a starting point, it will be assumed that the valve spool 128A is moved against the bias supplied by the spring 130A, that is, to the left as illustrated in FIGS. 3 and 4. In this position, compressed air enters the passageway 144A and the second enlarged diameter region 140A closes off communication between the passageway 144A and the exhaust passageway 142A. The check valve 148A is configured such that compressed air may pass from the passageway 144A to the passageway 154A but reverse flow is inhibited. Thus compressed air is supplied both to the inlet port 150A and the brake port 156. The check valve 148B is arranged similarly such that it allows compressed air flow from the passageway 144B to the passageway 154B but inhibits reverse flow. Therefore, the flow of compressed air from the passageway 154B which merges with the passageway 154A to the passageway 144B is inhibited by the check valve 148B. Air passing through the brake port 156 produces a force against the brake disk 76 which overcomes the force supplied by the compression spring 80 and lifts the brake disk 76 from the brake pad 82, thus terminating braking action and permitting rotation of the drive shaft 64. It should be noted that the chamber of the housing 22 within which the brake assembly 14 is disposed must be vented to atmosphere in order to maintain the face of the brake disk 76 opposite the brake pad 82 at substantially atmospheric pressure and ensure proper operation. Simultaneously, air is supplied to the pneumatic motor assembly 12 and specifically the rotor 48 and vanes 50 through the port 150A causing clockwise rotation of the rotor 48 and elongate drive shaft 64 as viewed in FIGS. 3 and 4. Such rotation is transferred through the reduction and drive assembly 16 causing the pneumatic hoist 10 to climb the stationary chain 108. This motion will continue as long as the valve spool 128*a* is depressed or until the housing 22 of the hoist 10 engages the upper one of the stop blocks 114.

A major portion of the exhaust air from the pneumatic motor assembly 112 exists the motor chamber through the exhaust port 160 and the exhaust passageways 162 and 42. As those familiar with bidirectional vane motors will readily appreciate, rotation of the motor rotor 48 and vanes 50 beyond the exhaust port 160 will result in recompression of the air which did not exit the exhaust port 160 as the various chambers defined by the rotor 48 and vanes 50 reduced in volume. Such recompression results in a loss of efficiency and output power. In the instant invention therefore, the ports 150A and 150B and passageways 144A and 144B serve a dual function. As just discussed, the passageway 144A supplies air to the pneumatic motor assembly 12 to provide clockwise rotation of the motor rotor 48. Simultaneously, the port 150B functions as a secondary exhaust port in this operational mode to exhaust the remaining air which has been trapped within the motor chamber 46. Such air exhausts through the passageway 144B around the valve spool 128B, through the exhaust passageway 142B and into the exhaust passageway 42 within the handle 40.

Release of actuating pressure on the actuator 132A causes the compression spring 130A to return the valve spool 128A to the position illustrated in FIGS. 3 and 4. The supply of compressed air through the passageway 144A is thus terminated and cessation of rotation of the motor rotor 48 and re-establishment of frictional contact between the brake disk 76 and brake pad 82 occurs. The shaft 64 is thus prevented from rotating and the hoist 10 ceases vertical translation.

Downward travel of the hoist 10 is accomplished by depression of the actuator 132B and leftward translation of the valve stem 128B against the compression spring 130B. In this operational mode, compressed air is supplied through the passageway 144B, through the check valve 148B, through the brake port 156 to the brake disk 76 lifting it from the brake pad 82 and thus permitting rotation of the shaft 64. Compressed is also supplied to the motor rotor 48 through the port 150B causing rotation in the counterclockwise direction and paying out of the chain 108, thereby lowering the hoist 10 and any associated load. It should be apparent that, the check valve 148A inhibits the flow of air from the passageway 154A into the passageway 144A. A majority of the exhaust air from the motor chamber 46 exits through the exhaust port 160 and exhaust passageway 162 as has been previously described. In a fashion also similar to the previously described mode of operation, exhaust air also exits the motor assembly 12 through the port 150A, passageway 144A, around the valve spool 128A and the passageway 142A. It should be noted that the second enlarged diameter region 140B of the valve spool 128B substantially inhibits the flow of compressed air from the inlet passageway 126 to the exhaust passageway 142B. Downward traverse of the pneumatic hoist 10 is terminated when the actuator 132B is released or the housing 22 engages the lower one of the stop blocks 114.

It should be appreciated that the design of the pneumatic brake assembly 14 and control assembly 18 provides significantly improved operation over prior art designs. Specifically, the common and parallel supply of compressed air to both the pneumatic motor assembly 12 and the pneumatic brake assembly 14 results in positive and substantially simultaneous release of the brake disk 76 and rotation of the motor rotor 48. Furthermore, the serial utilization of two exhaust ports improves motor efficiency. finally, the use of supply air rather than motor exhaust air to release the pneumatic brake assembly 14 both improves efficiency and permits accurate design and prediction of brake performance through the adjustment of various parameters such as spring rate of the compression spring 80, as previously noted.

The foregoing disclosure is the best mode devised by the inventor for practicing this invention. It is apparent, however, that devices incorporating modifications and variations will be obvious to one skilled in the art of pneumatic brakes. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A pneumatic hoist comprising, in combination, a vane motor having a pair of inlet ports and and output shaft, a speed reduction mechanism driven by said output shaft of said vane motor, and a chain engaging sprocket operably coupled to said speed reducing mechanism, pneumatic brake means for selectively inhibiting rotation of said vane motor, said pneumatic brake means including a planar brake disk secured for rotation with said output shaft, a friction surface disposed generally parallel and adjacent said disk, means for biasing said brake disk into contact with said friction surface, valve means for controlling a flow of compressed air to said vane motor and said pneumatic brake means, and port plate means for directing compressed air to said vane motor and said brake means and exhaust air from said vane motor, said port plate means having a first pathway providing communication between said valve means and one of said inlet ports, a second pathway providing communication between said valve means and the other of said inlet ports, a pair of check valves providing unidirectional flow from a respective one of said first and said second pathways to a third pathway providing communication between said check valves and a region between said disk and said surface of said pneumatic brake means, whereby activation of said controlling means directs parallel flows of air to said vane motor to cause rotation thereof and to said pneumatic brake means to translate said brake disk away from said surface.

2. The pneumatic hoist of claim 1 wherein said output shaft include male splines and said planar brake disk includes complementary female splines and said biasing means is a compression spring concentrically disposed about said output shaft.

3. The pneumatic hoist of claim 2 wherein said compression spring has a spring constant of from 100 pounds per inch to 110 pounds per inch.

4. A pneumatic hoist comprising, in combination, a vane motor having a pair of inlet ports and an output shaft, a speed reduction mechanism driven by said output shaft of said vane motor, and a chaine engaging sprocket operably coupled to said speed reducing mechanism, pneumatic brake means for selectively inhibiting rotation of said vane motor, said pneumatic brake means including a planar brake disk secured for rotation with said output shaft, a friction brake surface disposed generally parallel and adjacent said disk, means for biasing said brake disk into contact with said brake surface and means for controlling a flow of compressed air to said vane motor and said pneumatic brake means, said just recited means including a pair of control valves each having a supply port, an exhaust port and a common port for independently and selectively providing communication between said common port and said exhaust port in a first deactivated position and between said supply port and said common port in a second, activated position, and port plate means for directing compressed air to said vane motor and said pneumatic brake means and exhaust air from said vane motor, said port plate means having a first pathway providing communication between said common port of one of said control valves and one of said inlet ports, a second pathway providing communication between said common port of the other of said control valves and the other of said inlet ports, a pair of check valves providing unidirectional flow from a respective one of said first and said second pathways to a third pathway providing communication between said check valves and a region between said planar disk and said surface, whereby activation of one of said valves provides air to release said pneumatic brake means and rotates said vane motor in one direction and activation of said other of said valves releases said pneumatic means and rotates said vane motor in the opposite direction.

5. The pneumatic hoist of claim 4 wherein said output shaft include male splines and said planar brake disk includes complementary female splines and said biasing means is a compression spring concentrically disposed about said output shaft.

6. The pneumatic hoist of claim 4 wherein said planar brake disk is fabricated of bronze and steel.

7. The pneumatic hoist of claim 4 further including a housing having a handle and wherein said vane motor includes an exhaust port disposed generally opposite said inlet ports and vented to atmosphere through said handle.

8. The port plate means of claim 1 wherein said just recited means defines first and second opposed sides, said first side including said first pathway, said second pathway and said friction surface of said second side including said third pathway.

9. The port plate means of claim 8 wherein said check valves are disposed in said port plate means and provide fluid communication from said first side to said second side and wherein said port plate means further includes a pair of apertures providing communication between a respective one of said pathways and said second side and an aperture providing communication between said third pathway and said first side.

10. The port plate means of claim 4 wherein said just recited means defines first and second opposed sides, said first side including said first pathway, said second pathway and said friction surface and said second side including said third pathway.

11. The port plate means of claim 10 wherein said check valves are disposed in said port plate means and provide fluid communication from said first side to said second side and wherein said port plate means further includes a pair of apertures providing communication between a respective one of said pathways and said second side and an aperture providing communication between said third pathway and said first side.

* * * * *